United States Patent [19]

Bergman

[11] 4,364,207

[45] Dec. 21, 1982

[54] EXTENDED SPACE ENCLOSING STRUCTURE

[76] Inventor: Helmut Bergman, 116 Newport Ave., Scarborough, Ontario, Canada, M1L 1J5

[21] Appl. No.: 206,071

[22] Filed: Nov. 12, 1980

Related U.S. Application Data

[63] Continuation-in-part of Ser. No. 64,756, Aug. 8, 1979, Pat. No. 4,258,513.

[51] Int. Cl.[3] ..... E04B 1/32

[52] U.S. Cl. ..... 52/81; 52/DIG. 10

[58] Field of Search ..... 52/81, 80, 82, DIG. 10

[56] References Cited

U.S. PATENT DOCUMENTS

| | | | |
|---|---|---|---|
| 3,006,670 | 10/1961 | Schmidt | 52/81 |
| 3,341,989 | 9/1967 | Emmerich | 52/DIG. 10 |
| 3,611,620 | 10/1971 | Perry | 52/81 X |
| 3,611,620 | 10/1971 | Perry | 52/81 |
| 3,722,153 | 3/1973 | Baer | 52/81 |
| 3,810,336 | 5/1974 | Sadao | 52/81 |
| 3,854,255 | 12/1974 | Baker | 52/81 |
| 4,160,345 | 7/1979 | Nalick | 52/81 |
| 4,258,513 | 3/1981 | Bergman | 52/81 |

FOREIGN PATENT DOCUMENTS

| | | | |
|---|---|---|---|
| 1458056 | 10/1966 | France | 52/DIG. 10 |
| 166809 | 4/1934 | Switzerland | 52/DIG. 10 |
| 2410 | of 1913 | United Kingdom | 52/DIG. 10 |
| 1244842 | 9/1971 | United Kingdom | 52/81 |

OTHER PUBLICATIONS

Domebook II, Aug. 1971, pp. 102, 103, "Pacific Domes".

*Primary Examiner*—J. Karl Bell

*Attorney, Agent, or Firm*—Riches, McKenzie & Herbert

[57] ABSTRACT

A space enclosing structure, the underlying shape of which is a portion of a polyhedron comprised of a regular arrangement of regular pentagons, equilateral triangles, rhombi, right angled parallelograms and rhomboids. The structure permits the use of square and/or rectangular standardized prefabricated square or rectangular building units such as doors, windows, solar panels, etc., without any alteration of the basic shape of the structure, as such prefabricated units may be used to replace any of the square or rectangular faces of the polyhedron. Each face other than a right angled parallelogram is abutted on each side by a right angled parallelogram. Each right angled parallelogram is abutted on two opposite sides by rhomboids and/or rhombi and on the other two sides by a pentagon and a triangle.

3 Claims, 8 Drawing Figures

EXTENDED SPACE ENCLOSING STRUCTURE

This application is a continuation-in-part of application Ser. No. 64,756 filed Aug. 8, 1979 now U.S. Pat. No. 4,258,513.

BACKGROUND OF THE INVENTION

Space enclosing structures in the shape of "geodesic" polyhedral domes employing a minimum of regular geometric shaped surfaces have become increasingly popular over the last twenty-five years. These structures have been used, amongst other things, for buildings of all sizes. The large volume-to-surface area ratio has made them especially appealing to those in the building trade as the cost of building materials increases.

One major problem encountered with adapting these structures as standardized housing and the like is that most building materials, such as plywood sheeting and prefabricated units such as windows or solar heating panels, are rectangular or square in shape. Most structures known teach the use of non-rectangular units such as triangles, pentagons and hexagons from which the structure is constructed. If a window is to be inserted, it must be specially shaped to one of these three designs or, alternatively, the dome unit must be adapted to accept a standard square or rectangular unit. Both of these procedures increase construction time and costs.

The applicant is familiar with a rhombicosadodecahedronal structure which can use square building units. However, the small number of surface units defining the polyhedral structure based on this shape, namely 62, restricts the size of same when using ordinary (4'×8') sized prefabricated structures.

BRIEF DESCRIPTION OF THE INVENTION

Accordingly, it is an object of the present invention to provide a polyhedral dome-like space enclosing structure which may conveniently be used as a design for buildings and the like, wherein the structure includes square and/or rectangularly shaped areas on the surface thereof. This allows the use of standard form structures such as rectangular windows, grating, air conditioners, solar panels, and the like without any adjustment of the surfaces defining the dome.

To this end, in one of its aspects, the invention provides a space enclosing structure having an outer edge comprising a dome-like portion of an expanded non-regular rhombic triacontahedronal form;

(a) the non-regular rhombic triacontahedronal form, which is expanded, comprising a deregularized regular rhombic triacontahedronal form of rhombus surfaces, each having acute and obtuse vertices and four outer edges, the outer edges of the said rhombus surfaces defining six sets of equivalent non-coplanar parallel edges, the non-regular rhombic triacontahedronal form having each of at least one of the six sets of non-coplanar parallel edges of a length different than the lengths of each of at least one other of the six sets of non-coplanar parallel edges, to so transform at least some of the rhombus surfaces into rhomboid surfaces;

(b) the non-regular rhombic triacontahedronal form being expanded into the expanded non-regular rhombic triacontahedronal form by an outward parallel displacement of each of the rhomboid and rhombus surfaces respectively, to define (i) an equilaterally triangular surface between previously contiguous obtuse vertices (ii) a regularly pentagonal surface between previously contiguous acute vertices, and (iii) a right angled parallelogram surface between the previously colinear outer edges of the rhomboid and rhombus surfaces, the triangular and pentagonal surfaces all being equivalent, respectively;

(c) the non-regular rhombic triacontahedronal form comprising the form defined by the said rhomboid, rhombus, triangular, pentagonal, and right angled parallelogram surfaces.

BRIEF DESCRIPTION OF THE DRAWINGS

Further objects and advantages of the invention will appear from the following description taken together with the accompanying drawings in which.

DESCRIPTION OF THE PREFERRED EMBODIMENTS

Structures of the type of the present invention may be defined either by the orientation of skeletal brace members 12 to which the wall covering units are applied or by the orientation of the repeating planar geometric shapes, corresponding to the faces 10, which define the outer shape of the structure. The following description will make use of both methods of defining the structure. The structure is in effect a portion of a polyhedron of different geometric shapes, or that same structure wherein some of the faces have been replaced with non-planar faces.

Figure 1:
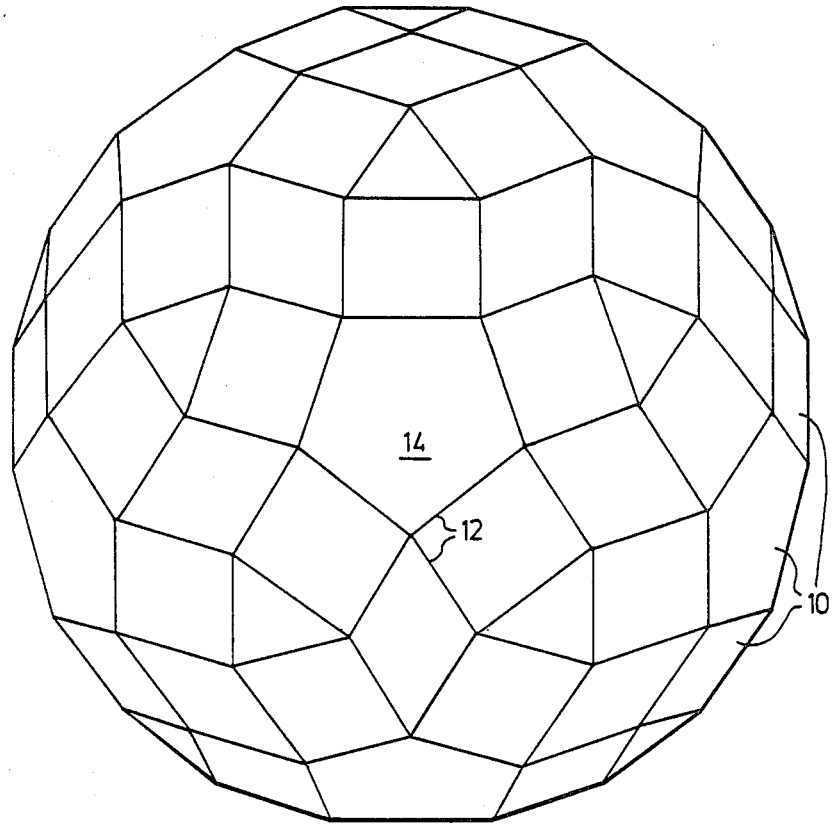
FIG. 1 is a view of an expanded regular rhombic triacontahedron.
Figure 4:
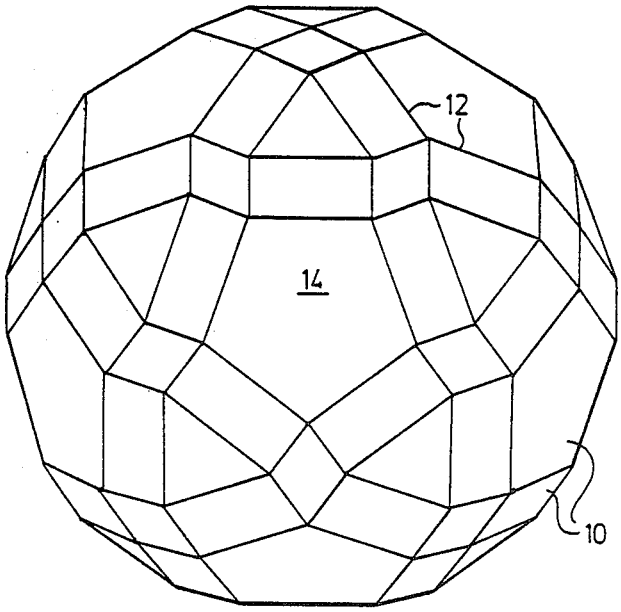
FIG. 4 is a view of an expanded regular rhombic triacontahedron where the right angled parallelograms are rectangles.
Figure 5:
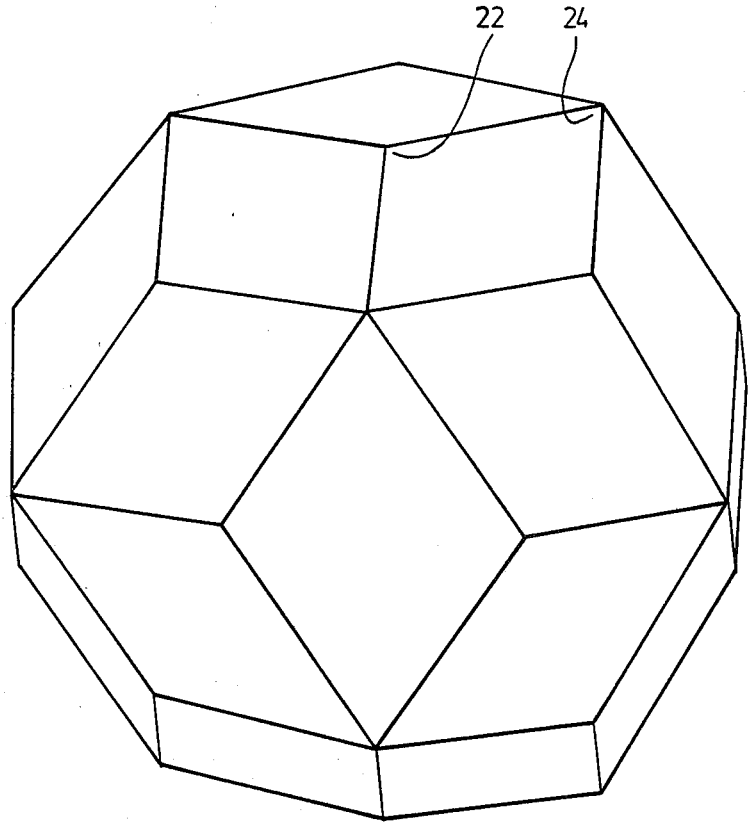
FIG. 5 is a perspective view of a rhombic triacontahedron.
Figure 6:
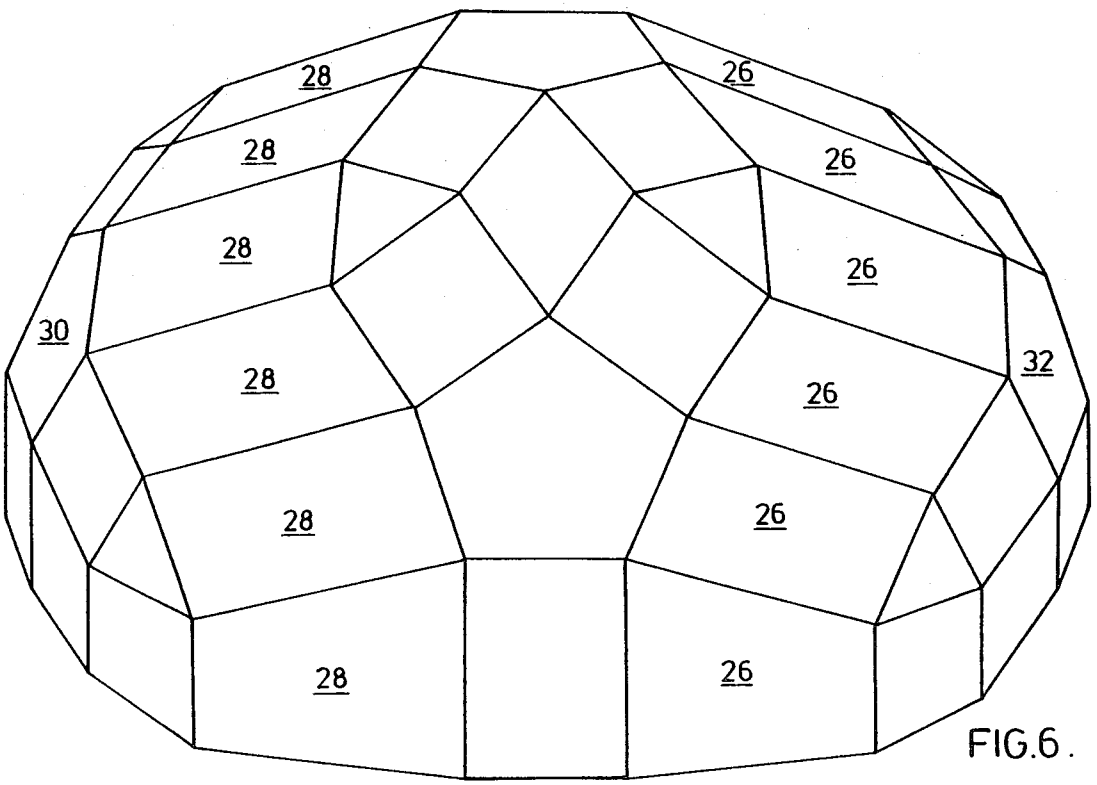
FIG. 6 is a perspective view of a preferred embodiment showing an expanded non-regular rhombic triacontahedronally based structure.

In this application, a non-regular rhombic triacontahedron is a rhombic triacontahedron in which at least some of the surfaces are rhomboids. An expanded rhombic triacontahedron is herein defined as a rhombic triacontahedron in which the surfaces defining same have been each outwardly displaced into a respective parallel plane so that each of the previously contiguous obtuse vertices of the rhombi now define an equilaterally triangular space and each of the previously contiguous acute vertices of the rhombi now define a regularly pentagonal space. This will result in right angled parallelogram spaces being defined between the previously co-linear edges of each rhombus. FIG. 5 shows a regular rhombic triacontahedron. FIGS. 1 and 4 show expanded regular triacontahedrons. Note that all the right angled parallelograms are either all equivalent squares or all equivalent rectangles in an expanded regular rhombis triacontahedron. FIG. 6 shows an expanded non-regular rhombic triacontahedron where the rhomboids, rhombi and right angled parallelograms are not all equivalent, respectively.

The only distinction between FIGS. 1 and 4 is the shape of the right angled parallelograms used. The shape of this unit can be chosen so that it most easily accommodates the standard form building structure, such as windows, prefabricated wall panels and doors, being used.

Reference will now be made to those features shown in FIGS. 1 to 5.

The angular orientation of each of the faces 10 defining the structure based on a regular rhombic triacontahedron are fixed whatever the shape of the right angled parallelogram. The size of each other unit is also fixed once the size of the right angled parallelogram is fixed. If a square is used then each edge of each unit is the same length. The advantages in ordering building supplies are obvious in this instance. If the right angled parallelogram chosen is rectangular in shape then the brace members 12 will be of two different lengths, the two lengths corresponding to the two lengths of the sides of the rectangular face.

The faces 10 are shaped as regular pentagons, equilateral triangles, right angled parallelograms (squares or rectangles) and rhombi. Each pentagon and each triangle is abutted on each side by a side of a right angled parallelogram, and each right angled parallelogram is abutted on one side by a pentagon and on the opposite side by a triangle. Rhombi abut the other two opposing sides of each right angled parallelogram. The sides of rhombi only abut the sides of right angled parallelograms.

Figure 2:
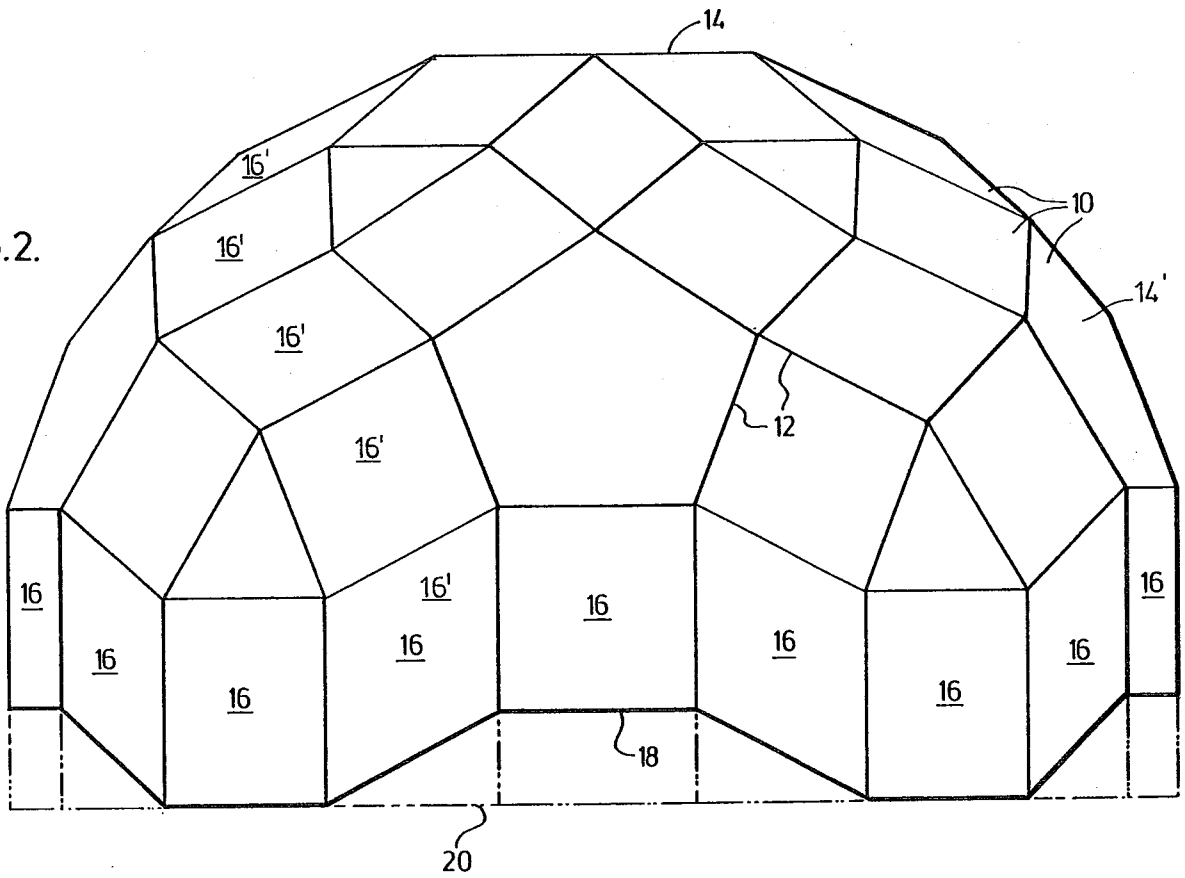
FIG. 2 is a side view of an embodiment constructed from the form shown in FIG. 1.
Figure 3:
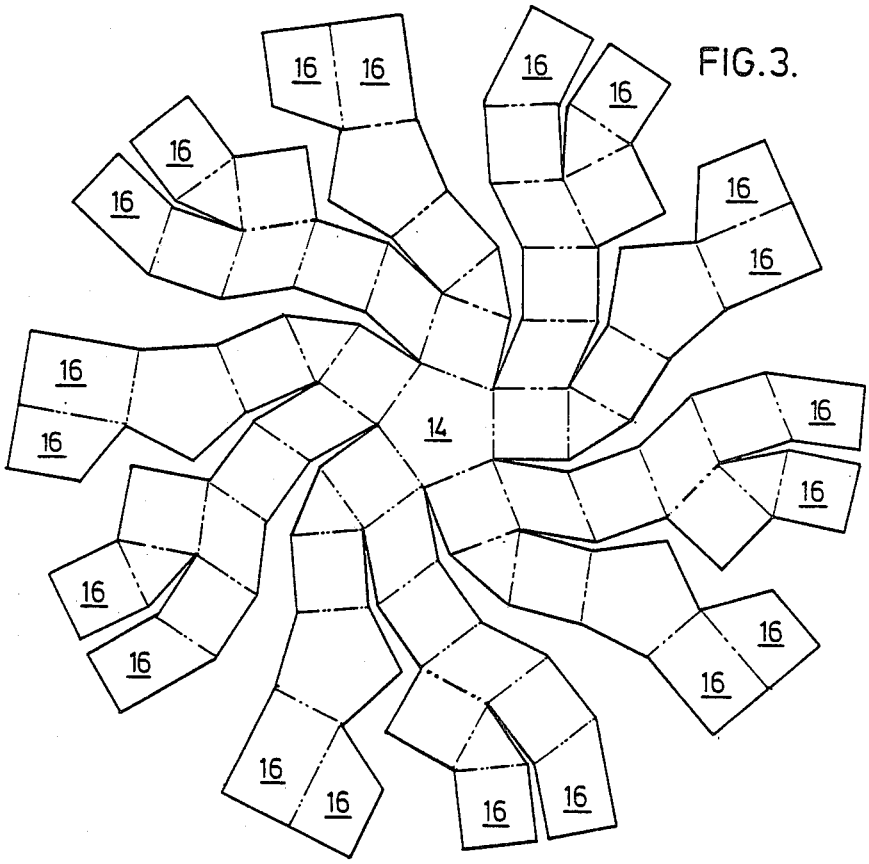
FIG. 3 is a schematic illustration of the pattern of arrangement of shapes employed to form the structure shown in FIG. 2.

This arrangement produces the shaped structures shown in FIGS. 1, 2 and 4. As far as the applicant is aware, no other arrangement of these shapes to produce a space enclosing structure is possible.

The orientation of shapes in this structure produces an additional advantage in that all the vertices of the structure are of one of two sets, that set defined by a triangle, two right angled parallelograms and a rhombus and that set defined by a pentagon, two right angled parallelograms and a rhombus. This implies that only two prefabricated joint members are required to connect the skeletal brace members 12. This greatly simplifies the building procedures. If for any reason one set of the vertices should be moved towards or away from the centre of the structure, this can be done by replacing each rhombus with a pair of non-planar isosceles triangles, the particular vertices being moved being retained in the isosceles triangles.

The structures in FIGS. 1 to 4, and 6 to 8, are derived from the structure shown in FIG. 5, a rhombic triacontahedron. Each rhombus is displaced in a respectively parallel plane and is connected along its sides by right angled parallelograms to the sides of the adjacent rhombi. In a rhombic triacontahedron the rhombi meet at apexes defined by three obtuse vertices 22 or five acute vertices 24. In the expanded form, between the three obtuse vertices 22 is placed an equilateral triangle and between the five acute vertices 24 is placed a regular pentagon. The vertices of the rhombi touch the vertices of the triangle and pentagons. The angles at the obtuse and acute vertices are 116° 33′ 54″ and 63° 26′ 06″ respectively.

These angles remain constant in the rhombic triacontahedron and in the regular and non-regular expanded rhombic triacontahedron.

The drawings in FIGS. 1 to 4 all show a central, or uppermost, or polar face 14 which is pentagonal in shape. By so arranging the orientation of the faces 10 in this manner, when the polar face 14 is parallel to the ground or support upon which it is sitting then a plurality of vertical or equatorial faces 16 are created. The lower edges 18 of the equatorial faces 16 can be extended to create an extended coplanar lower edge 20 which is parallel to the polar face 14 as shown in FIG. 2. An obvious advantage of the structure in FIG. 2 as an architectural design for a building is the fact that these equatorial faces 16 can be fitted with vertically oriented doors or windows without substantial expense as would be required if they were not vertical.

When considering which shape the right angled parallelograms are to be, consideration should be given to factors such as the desired shape of equatorial faces 16. By varying the amount of the extension of the edge 20, the desired length of an equatorial face 16 can be achieved. Window or solar heating panel sizes should also be considered as these can easily replace right angled rectangular panels on the surface of the structure without extensive working. With 25 right angled parallelogram shaped areas in a hemispherically shaped structure as shown in the Figures, other than as equatorial faces 16, a properly oriented right angled parallelogram surface can always be found in which to locate windows, solar panels and the like.

The embodiments shown in FIGS. 1 to 4 are based upon an expanded regular rhombic triacontahedronal form. It is possible to replace some of the different planar geometric faces 10 with other shaped faces. For instance, each pentagon face could be replaced with an arrangement of five triangular shaped faces which may or may not be coplanar. The bases of each of the five triangles will be coplanar. Any individual face 10 may be replaced with any type of non-planar surface but that non-planar surface meets or intersects the other faces along a locus of points equivalent to the locations of the brace members 12.

It is also possible to span the area defined by two or more faces 10 with a single non-planar surface. This however defeats the advantages of the present invention wherein a few sizes of simply shaped units can be assembled into a space enclosing structure.

The hemispherical structure shown in FIGS. 1 to 4 is not the only possible structure. The structure may be more or less enclosing than that shown in FIG. 2. One of the advantages of the form shown in FIG. 2 is the possibility of vertically oriented walls 16 which can be adjusted to have a coplanar base 20. This simplifies the construction of supporting structures, such as poured concrete bases, as well.

Another advantage of the structure shown in FIGS. 1 to 4 is that horizontal members, such as floors in buildings, can be easily oriented against the surface of the structure. The symmetry of the structure implies that there are at least four points identically placed corresponding to each other point in the structure shown in FIG. 2. Each of these five identically placed points will be identically displaced above the coplanar base 20 and so define a plane parallel to base 20. Once the supporting structure for the base 20 is fixed and levelled, then each of these other planes will also be level. This will greatly simplify construction procedures for the unsophisticated builder.

Figure 7:
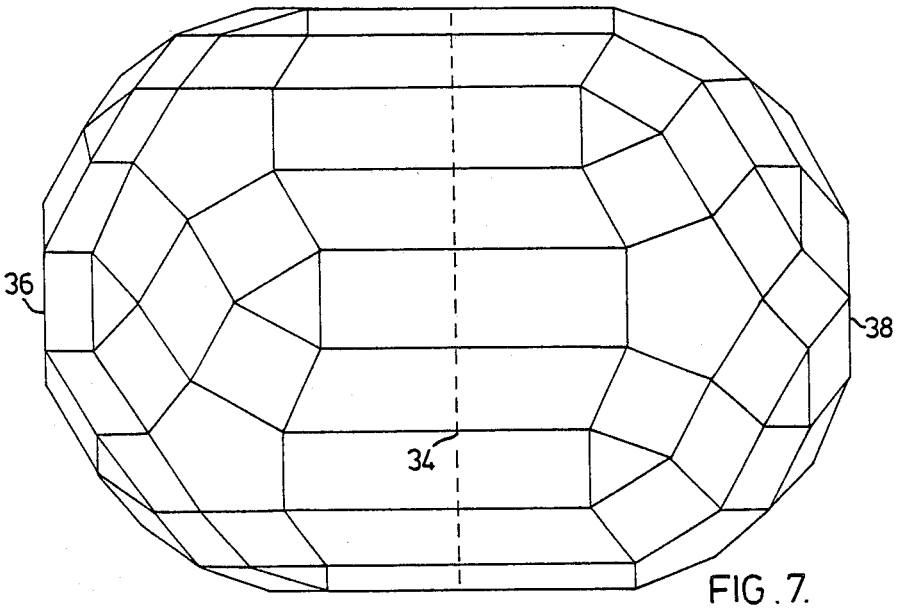
FIGS. 7 and 8 show views of other embodiments of the invention derived from the embodiment shown in FIG. 6.
Figure 8:
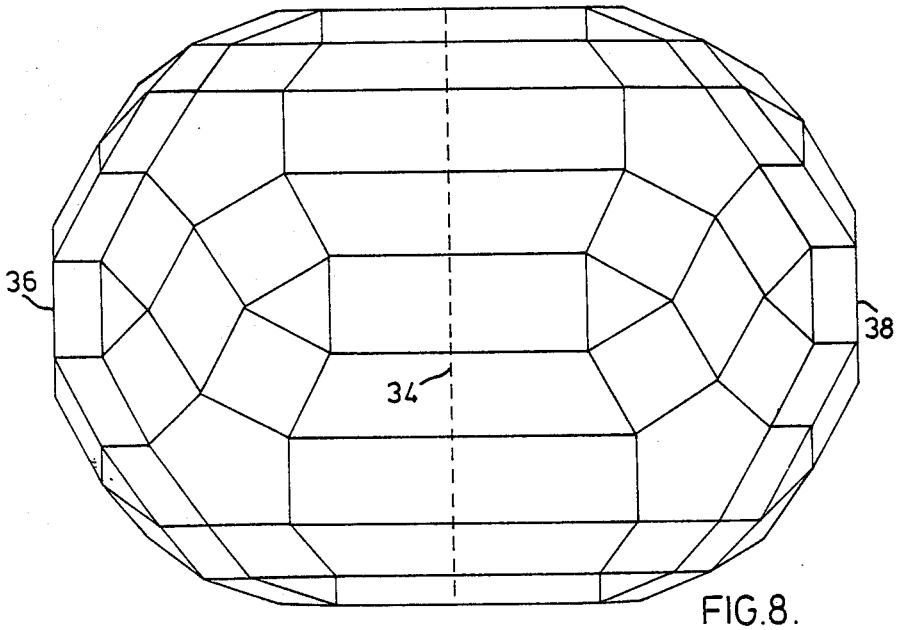

Reference is now made to the embodiments of the present invention shown in FIGS. 6 to 8. FIG. 6 shows an expanded non-regular rhombic triacontahedronal form. FIG. 2 shows a structure wherein the equatorial faces 16 are extended to lower edge 20, which defines a plane parallel to the polar face 14. Because of the symmetry of the rhombic triacontahedron, it will be readily apparent that there are five other sets of faces encircling an expanded rhombic triacontahedron, each of which faces in each of said sets of faces being normal to the plane defined by the respective "polar face". For example, referring to FIG. 2, each face marked as 16' would be in a set of faces encircling a complete expanded rhombic triacontahedron each of which faces would be normal to the plane defined by the pentagonal face 14'.

Because of the fact that each of the faces in an encircling set are normal to the plane defined by its respective "polar face", it is possible to extend each of these faces an equivalent amount and still retain the angular relationship of each face in the form. Each encircling set of faces must be a set comprised of rhomboids or rhombi and right angled parallelograms, alternately. The edges of the faces in each of the encircling sets common to both the rhomboids or rhombi and the right angled parallelograms are parallel to each other, as they are all normal to the plane defined by the respective "polar face". Each encircling set of faces can, in fact, be defined as an encircling set of faces in which the common edges of adjacent faces are coparallel. The term "encircling set of faces" in this application will only be used to refer to that set of faces in which the common edges of all adjacent faces are co-parallel. In a complete expanded rhombic triacontahedron there are six such encircling sets of faces.

The expanded rhombic triacontahedronal form in FIG. 2 is transformed into the expanded non-regular rhombic triacontahedronal form shown in FIG. 6 by extending two encircling sets. The "polar faces" for extended faces 26 and 28 are, respectively, faces 30 and 32. The extended faces 26 and 28 need not be extended to the same degree. This permits total flexibility in using this structural form to choose at least two different right angled parallelogram shaped pre-built building units, such as doors and windows, as are needed. Although it will effect the shape and size of every other face in the same encircling set, any one right angularly parallelogram face in a set can be made to whatever size desired. The choosing of the size of one rhombus, rhomboid or right angled parallelogram effects the sizes of all of the other ones in the set because all of the co-parallel edges in the set must be of the same length. Every right angled parallelogram in each encircling set will be identical to each other right angled parallelogram. The rhomboids and rhombi in the encircling sets need not be identical in size, and in fact will not be identical in size if the right angled parallelograms in the different sets are not of the same size. Each rhombus or rhomboid is a member of two encircling sets. One pair of opposing edges of the rhomboid or rhombus will reflect the same size as the co-parallel edges of the right angled parallelograms in the set incorporating those two edges of the rhomboid or rhombus. The other two opposing edges of the rhomboid or rhombus will reflect the size of the co-parallel edges of the right angled parallelograms in another set.

The same two prefabricated joint members which can be used to assemble a space enclosing structure, comprising a dome-like portion of a regular expanded rhombic triacontahedron, can be used with the embodiment in this invention. This embodiment therefore has all of the advantages of the structure shown in FIG. 2 with the additional advantage that more than one size of rectangular and/or square prefabricated building units can be readily adapted to the structure without alteration of the chosen skeletal form. The enclosing space can be made larger or smaller as desired, by expanding or contracting any encircling set of faces while the angular values of the vertices remain constant.

FIG. 7 is a view of an expanded non-regular rhombic triacontahedronal form with only one encircling set of faces extended. It is very similar in structure to a form comprising two of the hemispherical structures shown in FIG. 2 connected along lower edges 20. This can be more readily seen if dotted line 34 in FIG. 7 is equated to lower edge 20 in FIG. 2. In effect, the structure shown in FIG. 2 is equivalent to one half of a structure defined by the form shown in FIG. 7.

The form shown in FIG. 8 is derived from the form shown in FIG. 7. The difference is that one half of the form in FIG. 7, as that form is divided by dotted line 34, is rotated 36° about a central axis, not shown, between pentagonal faces 36 and 38. This results in the encircling set of faces which in FIG. 7 are an alternating arrangement or rhomboids or rhombi and right angled parallelograms becoming an alternating arrangement of trapeziums and right angled parallelograms. This rotation is, of course, possible only if the five encircling sets of faces which are not at right angles to the axis of rotation are equivalent to each other insofar as the size of the right angled parallelograms and rhomboids or rhombi, respectively, are concerned.

The structure in FIG. 8 is not as preferred a structure as that shown in FIG. 6. There will, with the FIG. 8 structure, be no encircling set of faces encircling both halves of the structure at right angles to any pentagonal face except for that set shown in FIG. 8 as the central, vertical set, the set through which the rotation about the central axis was affected. Accordingly, it is not possible to have a set of vertically extending equatorial faces, equivalent to faces 16 in FIG. 2, about the entire base of the structure.

Although the description of this invention has been given with respect to particular embodiments, it is not to be construed in a limiting sense. Many variations and modifications will now occur to those skilled in the art. For a definition of the invention, reference is made to the appended claims.

What I claim is:

1. A space enclosing structure, having an outer edge, comprising a dome-like portion of an expanded non-regular rhombic triacontahedronal form, (a) the non-regular rhombic triacontahedronal form, which is expanded, comprising a deregularized regular rhombic triacontahedronal form of rhombus surfaces, each having acute and obtuse vertices and four outer edges of the said rhombus surfaces defining six sets of equivalent non-coplanar parallel edges, the non-regular rhombic triacontahedronal form having each of at least one the six sets of non-coplanar parallel edges of a length different than the length of each of at least one other of the six sets of non-coplanar parallel edges, to so transform at least some of the rhombus surfaces into rhomboid surfaces;

(b) the non-regular rhombic triacontahedronal form being expanded into the expanded non-regular rhombic triacontahedronal form by an outward parallel displacement of each of the rhombus and rhomboid surfaces, respectively, to define (i) an equilaterally triangular surface between previously contiguous obtuse vertices, (ii) a regular pentagonal surface between previously contiguous acute vertices, and (iii) a right angled parallelogram surface between the previously colinear outer edges of the rhombus and rhomboid surfaces, the triangular and pentagonal surfaces all being equivalent, respectively;

(c) the non-regular rhombic triacontahedronal form comprising the form defined by the said rhombus, rhomboid, triangular, pentagonal and right angle parallelogram surfaces.

2. A space enclosing structure as claimed in claim 1 wherein the dome-like portion approximates a hemisphere having one uppermost face, comprising one of the pentagonal surfaces, and an encircling set of equatorial faces each of which faces is one of the rhomboid, rhombus or right angle parallelogram surfaces and none of which is adjacent to the uppermost face, each of the said rhomboid, rhombus and right angle parallelogram surfaces having one outer edge comprising part of the outer edge of the structure, the equatorial faces being distorted so that the said one outer edges are coplanar to each other and parallel to the uppermost face.

3. A space enclosing structure as claimed in claim 1 comprising a dome-like portion of an expanded non-regular rhombic triacontahedronal form wherein each of the six sets of non-coplaner parallel edges defines one of six encircling sets of rhomboids, rhombi and right angle parallelograms, one of the encircling sets of rhomboids, rhombi and right angle parallelograms dividing the form into two halves, the five encircling sets of rhomboids, rhombi and right angle parallelograms not dividing the form into two equal halves having all the right angled parallelograms thereof equivalent to each other, wherein one of the two halves of the form is rotated 36° about an axis parallel to and equidistant from each of the rhomboids in the encircling set dividing the form into halves to define an encircling set of shapes, dividing the form into halves, comprising an arrangement of alternating right angled parallelograms and trapeziums.

* * * * *